US011357364B2

(12) United States Patent
Ray

(10) Patent No.: US 11,357,364 B2
(45) Date of Patent: Jun. 14, 2022

(54) DISPENSER AND CONTAINER

(71) Applicant: GOJO Industries, Inc., Akron, OH (US)

(72) Inventor: Eugene William Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/157,991

(22) Filed: Jan. 25, 2021

(65) Prior Publication Data

US 2021/0153699 A1 May 27, 2021

Related U.S. Application Data

(63) Continuation of application No. 16/384,885, filed on Apr. 15, 2019, now Pat. No. 10,898,033, which is a continuation of application No. 14/617,196, filed on Feb. 9, 2015, now Pat. No. 10,258,203.

(60) Provisional application No. 61/937,169, filed on Feb. 7, 2014.

(51) Int. Cl.

| | |
|---|---|
| ***A47K 5/12*** | (2006.01) |
| ***B05B 11/04*** | (2006.01) |
| *B65D 35/28* | (2006.01) |
| *B65D 83/00* | (2006.01) |
| *B65D 33/04* | (2006.01) |

(52) U.S. Cl.

CPC ..... *A47K 5/1211* (2013.01); *B05B 11/048* (2013.01); *A47K 5/1208* (2013.01); *B65D 33/04* (2013.01); *B65D 35/28* (2013.01); *B65D 83/0072* (2013.01); *B65D 83/0077* (2013.01); *B65D 83/0094* (2013.01)

(58) Field of Classification Search

CPC .. A47K 5/1211; A47K 5/1208; B05B 11/048; B65D 35/28; B65D 83/0094; B65D 83/0077; B65D 33/04; B65D 83/0072

See application file for complete search history.

(56) References Cited

U.S. PATENT DOCUMENTS

| | | | | |
|---|---|---|---|---|
| 5,046,648 A * | 9/1991 | Herbstzuber | ..... | G01F 11/021 222/638 |
| 5,242,084 A * | 9/1993 | Jinotti | ..... | A61M 5/148 222/103 |
| 9,045,268 B2 * | 6/2015 | Pelfrey | ..... | B65D 21/086 |

* cited by examiner

*Primary Examiner* — Donnell A Long

(74) *Attorney, Agent, or Firm* — Cooper Legal Group, LLC

(57) ABSTRACT

Among other things, a dispenser for dispensing material is provided herein. The dispenser includes a cover. The dispenser is configured to receive a container from which material is dispensed. The container is adapted to be supported by the cover. Biasing structure is adapted to apply a force to the container to facilitate dispensing the material from the container.

20 Claims, 8 Drawing Sheets

DISPENSER AND CONTAINER

CROSS-REFERENCE TO RELATED APPLICATIONS

This application is a divisional application of U.S. patent application Ser. No. 16/384,885, filed on Apr. 15, 2019, titled "DISPENSER AND CONTAINER." That application claims priority to U.S. patent application Ser. No. 14/617,196, filed on Feb. 9, 2015, titled "DISPENSER AND CONTAINER." That application claims priority to U.S. Provisional Patent Application No. 61/937,169, filed on Feb. 7, 2014, titled "DISPENSER AND CONTAINER", the entire disclosures of which are hereby incorporated by reference.

TECHNICAL FIELD

The instant application is generally directed towards a dispenser and container for dispensing a fluent material. In particular, the instant application is directed to at least one of the dispenser or the container having biasing structure to facilitate dispensing the material.

BACKGROUND

Many locations, such as hospitals, factories, restaurants, homes, etc., utilize dispensers to dispense fluent material. For example, a dispenser may dispense a liquid material, powder material, aerosol material, and/or other materials (e.g., soap, anti-bacterial gels, cleansers, disinfectants, lotions, etc.). Some dispensers incorporate a container for at least temporarily storing a relatively large quantity of the material until it is repeatedly dispensed in relatively small quantities. The container may be removed from the dispenser when it is empty and replaced by a replacement container or refilled container.

The container may be a bag that collapses and reduces in volume as material is dispensed or a rigid bottle in which the material flows in a direction to the bottom of the bottle as material is dispensed. The dispenser may have a viewport through which the container can be seen in order to determine the volume of material remaining in the container.

Unfortunately, viewing the remaining volume in the container may have detrimental consequences. For example, the bag may not collapse sufficiently and/or the material may pool in a location that is not visible in the viewport and, thus, the container may appear to be empty or near empty when it is not. A user may have a tendency to avoid using a dispenser that appears to be empty even though there may be a sufficient quantity of material within the dispenser. Such nonuse can lead to dissatisfied users, added cost to replace a container that is not empty and waste of material.

SUMMARY

This summary is provided to introduce a selection of concepts in a simplified form that are further described below in the detailed description. This summary is not intended to identify key factors or essential features of the claimed subject matter, nor is it intended to limit the scope of the claimed subject matter.

According to an embodiment, a dispenser for dispensing material is provided. The dispenser includes a cover. The dispenser also includes a container from which material is dispensed. The container is adapted to be supported by the cover. Biasing structure is adapted to apply a force to the container to facilitate dispensing the material from the container.

According to another embodiment, a dispenser for dispensing fluent material is provided. The dispenser includes a cover to support the dispenser for use. A container is mounted within the cover. The container is for storing the material. The container includes a first section constructed to resist deformation. The first section has an outlet for dispensing the material. The container also includes a second section constructed to be deformable. Biasing structure is associated with the second section of the container. The biasing structure is constructed to apply a force to deform the second section of the container and urge the material into the first section.

In another embodiment, a container for fluent material is provided. The container is used with a dispenser for dispensing the material. The dispenser has a cover to mount the dispenser for use. The dispenser also has biasing structure effective to provide a biasing force to the container. The container includes a first section with an outlet for material to exit the container. The first section is constructed to resist deformation. The container has a second section constructed to be at least partially deformable in response to the biasing force applied by the biasing structure and urge the material into the first section of the container.

In another embodiment, a container for fluent material and for dispensing the material is provided. The container includes a first section with an outlet for material to exit the container. A second section is in communication with the first section. Biasing structure in the second section provides a biasing force to material in the container to urge the material into the first section.

In another embodiment, a dispenser for dispensing material is provided. The dispenser includes a cover. Biasing structure is adapted to apply a force to a container to facilitate dispensing material from the container.

The description and drawings set forth certain illustrative aspects and implementations. These are indicative of but a few of the various exemplary ways in which one or more aspects can be employed. Other aspects, advantages, and novel features of the disclosure will become apparent from the following detailed description when considered in conjunction with the drawings.

DETAILED DESCRIPTION

Figure 2:
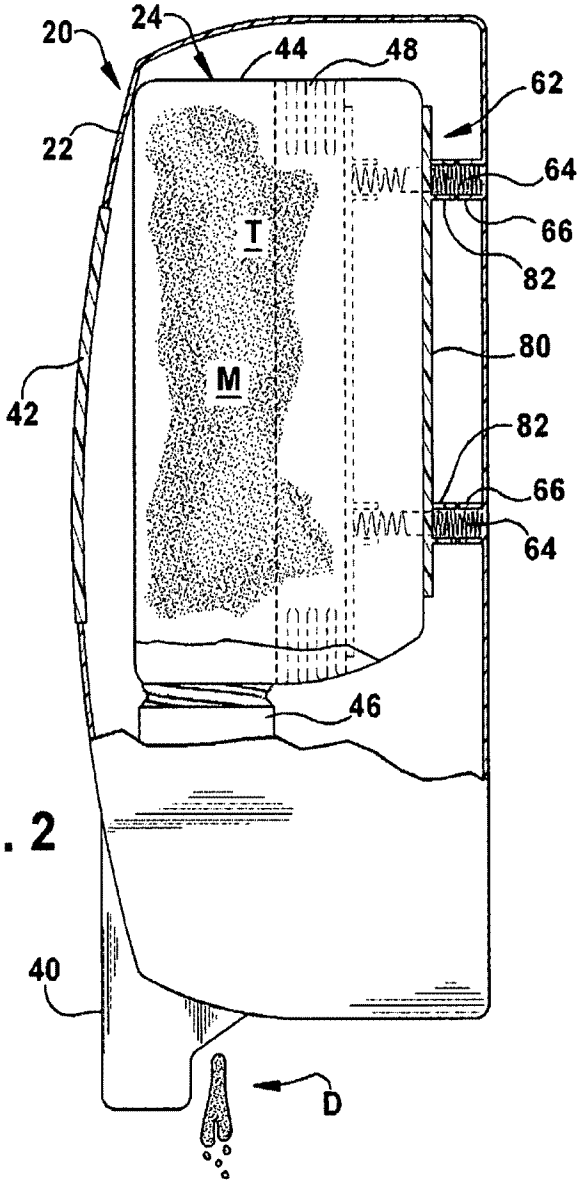
FIG. 2 is a cross-sectional view illustrating a container and biasing structure.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details.

Figure 1:
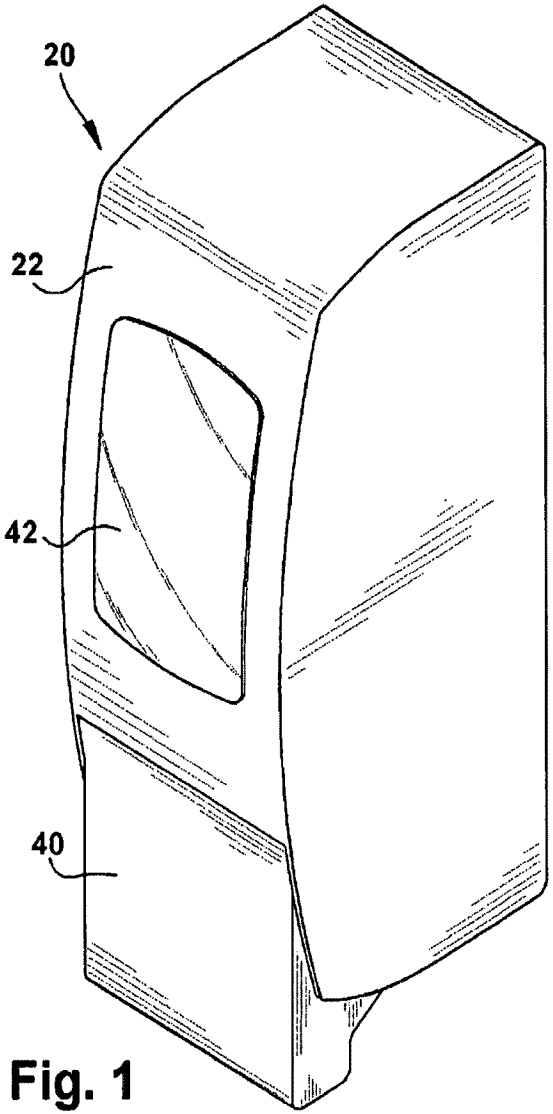
FIG. 1 is a perspective view of a dispenser according to an embodiment.

A dispenser 20, according to at least one embodiment, is illustrated in FIG. 1 and FIG. 2 and is functional to appear as being full of material M to be dispensed for a period of time relatively longer than previously experienced. This is accomplished by moving the material M in the dispenser 20 into a predetermined region of the dispenser.

An exemplary dispenser 20 (FIGS. 1 and 2) is for dispensing a fluent material M. The material M may be any suitable material, such as liquid material, powder material, aerosol material, and/or other materials (for example, soap, anti-bacterial gels, cleansers, disinfectants, lotions, etc.).

The dispenser 20 includes a housing or cover 22 configured to mount and support a container 24 (FIG. 2) for use. The container 24 receives and stores the fluent material M to be dispensed D. Typically, the container 24 stores a relatively large amount of fluent material M and dispenses D the fluent material in relatively smaller quantities upon actuation of the dispenser 20. The container 24 is preferably removable from the cover 24 when the container is empty and replaced with a new replacement container or refilled container.

The dispenser 20 may include a pump and/or dispenser valve mechanism (not shown) that can be actuated to dispense material M. The cover 22 defines a lower material dispense zone comprising an area within which a dispensed material D exits the dispenser 20. The cover 22 may include various mechanical and/or electrical components (not shown) that facilitate operation of the dispenser 20, such as sensor or handle 40 to effect dispensing of material M upon actuation. For example, a user may place a hand under any suitable proximity sensor, such as an optical, thermal, infrared or motion type of proximity sensor, or by depressing a handle, to actuate the dispenser 20 to dispense the material M.

The cover 22 also includes a viewport 42 through which material M in the container 24 may be viewed as an indication of the amount of material remaining in the container. The container 24 is preferably made from any suitable material, such as plastic, that is transparent so that the material M within the container is visible. When the material M in the container 24 is visually determined to be empty, the container may be removed and replaced.

The container 24, according to the embodiment illustrated in FIG. 2, defines a variable volume vessel and is constructed to have at least a portion decrease in volume as the material M is dispensed. The container 24 includes a first section 44 that is relatively rigid and resists deformation. The first section 44 has an outlet 46 that is in fluid communication with the first section and through which the material M can be dispensed. The outlet 46 is used to mount the container 24 within the cover 22 and fluidly connect to the dispenser valve mechanism. While the outlet 46 is shown as being threaded, it will be apparent that any suitable mounting and connecting apparatus may be employed.

The container 24 also includes a second section 48 in fluid communication with the first section 44. The second section 48 of the container 24 is constructed to be deformable or collapsible so that the volume of the second section decreases as material M is dispensed from the container. The second section 48 of the container 24 may be of various constructions. For example, the second section 48 of the container 24 may be made from a material that is relatively less rigid than the first section 44. Alternatively or additionally, the second section 48 of the container 24 may be folded, creased, molded and/or otherwise formed to function as bellows and/or otherwise be deformable so as to collapse or otherwise reduce in volume. The collapsing action of the second section 48 of the container 24 causes the movement of the material M into the first section 44 of the container. Thus, when viewed through the viewport 42 the amount of material M in the container 24 appears to be fuller for a relatively longer period of time than in previous dispensers. This can promote prolonged/additional use the dispenser 20 to dispense material M, cause less frequent replacement of the container and reduce waste of material due to premature replacement of the container.

The cover 22 includes biasing structure 62. The biasing structure 62 exerts a force from the cover to the second section 48 of the container 24. This application of force causes the collapse or deformation of the second section 48 to reduce the volume of the second section. Reducing the volume of the second section 48 forces material M within the container in a direction towards the first section 44 so the container appears to be full with material for a relatively longer time.

The biasing structure 62 may be actuated by any suitable apparatus, such as mechanical actuation, fluid actuation and electric actuation. In the embodiment illustrated in FIG. 2, mechanical actuation is employed. Specifically, the mechanical actuation is provided by springs 64 that are compressed when in an initial position, as illustrated in solid lines in FIG. 2. The cover 22 includes several guides 66 in which an end of a respective one of the springs is disposed.

The cover 22 also includes a force applicator 80. The force applicator 80 includes a matching number of guides 82 in which opposite ends of the respective springs 64 are disposed. When material M is dispensed, the volume of material in the container 24 is permitted to decrease and the force applicator 80 moves to a second position, illustrated in dash lines in FIG. 2, and forces the second section 48 of the container to collapse or deform and, thereby, decrease in volume. Thus, material M in the container is forced into the first section 44 so that the container still appears to be full when viewed through the viewport 42.

Figure 3:
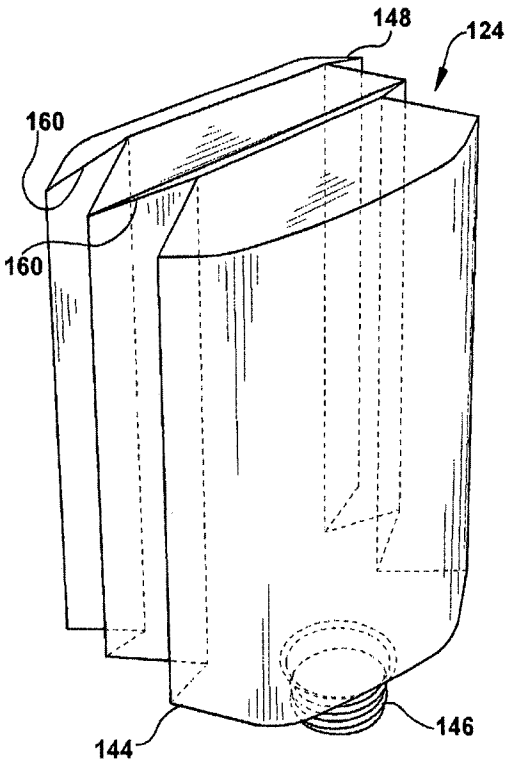
FIG. 3 is a perspective view, partially hidden, of a container according to another embodiment.

An alternate exemplary embodiment of a container 124 that is suitable for use in the dispenser 20 is illustrated in FIG. 3. The container 124 defines a variable volume vessel and is constructed to decrease in volume as the material M is dispensed. The container 124 includes a first section 144. An outlet 146 is in fluid communication with the first section 144 for material within the container 124 to exit the container. The container 124 is preferably made from a material that is transparent.

The container 124 also includes a second section 148 in fluid communication with the first section 144. The second section 148 of the container 124 is constructed to be deformable or collapsible so that the volume of the second section decreases as material is dispensed from the container. The container 124 may be blow molded of a suitable plastic. The second section 148 of the container 124 preferably is formed with a bellows-like portion or accordion folds 160 so that the second section is deformable and may collapse in a desired manner upon the application of biasing force from the dispenser 20.

The collapsing action of the second section 148 of the container 124 causes the movement of the material into the first section 144 of the container. Thus, when viewed through the viewport 42 of the dispenser 20, the container 124 appears to be full of material M. While the container 124 is illustrated as having two inwardly formed folds 160, any suitable number of folds may be employed. It will also be appreciated that while the folds 160 are illustrated as extending the entire length of the container 124 and having a substantially V-shape, the folds may be configured to have any suitable shape and size. For example, the folds 160 may have a rounded or U-shape and extend for a distance less than the entire length of the container 124. Such shorter folds 160 could be located at the bottom, middle and/or top of the container 124. Such shorter folds may (at least partially) inhibit collapse, folding deformation, etc. of (at least some of) the container 124. Moreover, the folds 160 can have any degree of rigidity to control the collapse, deformation, etc. of the container 124.

Figure 4:
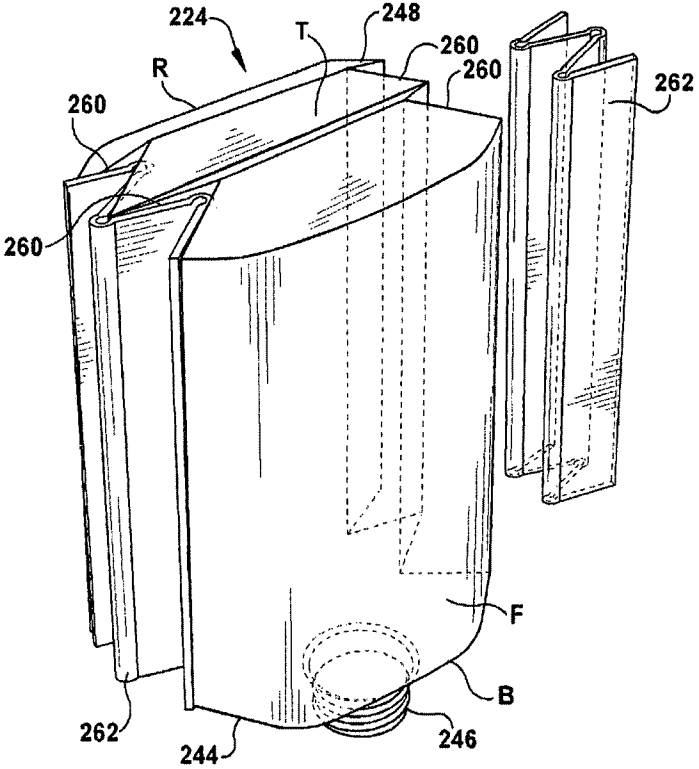
FIG. 4 is a perspective view, partially hidden, of a container according to another embodiment with a part removed for clarity.

Another exemplary embodiment of a container 224 that is suitable for use in the dispenser 20 is illustrated in FIG. 4. The container 224 defines a variable volume vessel and is constructed to decrease in volume as the material is dispensed. The container 224 includes a first section 244. An outlet 246 is in fluid communication with the first section 244 for material within the container 224 to exit the container. The container 224 is preferably made of a material that is transparent.

It will be appreciated that the container 224 can be constructed to apply the biasing force without external structure. For example, the container 224 could be molded from a resilient material in a shape that expands upon being filled with material. Upon dispensing material, a second section 248 of the container 224 will tend to contract to its original shape and reduce in volume to match the volume of material dispensed. The second section thus collapses in on itself as material is dispensed.

The second section 248 is in fluid communication with the first section 244. The second section 248 of the container 224 is constructed to be deformable or collapsible so that the volume of the second section decreases as material is dispensed from the container. The second section 248 of the container 224 may be formed of a suitable plastic. The second section 248 of the container 224 preferably is formed with a bellows-like portion or accordion folds 260 so that it is deformable and may collapse in a desired manner with or without the application of biasing force from the dispenser 20. Inserts 262 may be used to create the folds 260. The inserts 262 may be made in a manner so that collapse of the container 224 occurs from the rear R of the container in a direction towards the front F rather than in a direction from top T to bottom B. For example the inserts 262 may be made of a material that is relatively more rigid than the material from which one or more other portions of the container to 24 are made. The inserts 262 also act to stiffen and retain the height of the container 224 as the second section 248 collapses.

While the container 224 is illustrated as having two inwardly formed folds 260 and complimentary configured inserts 262, any suitable number of folds and/or inserts may be employed. It will also be appreciated that while the folds 260 and inserts 262 are illustrated as extending the entire length of the container 224 and having a substantially V-shape, the folds and/or inserts may be configured to have any suitable shape and size. For example, the folds 260 and/or inserts 262 may have a rounded or U-shape and extend for a distance less than the entire length of the container 224. Such shorter folds 260 and/or inserts 262 could be located at the bottom, middle and/or top of the container 224. Such shorter folds and/or inserts may (at least partially) inhibit collapse, folding deformation, etc. of (at least some of) the container 224. Moreover, the folds 260 and/or inserts 262 can have any degree of rigidity to control the collapse, deformation, etc. of the container 224.

The collapsing action of the second section 248 of the container 224 enables the movement of the material into the first section 244 of the container. Thus, when viewed through the viewport 42 of the dispenser 20, the container 224 appears to be full of material. While the container 224 is illustrated as having two inwardly formed folds, any suitable number of folds 260 may be employed.

Figure 5:
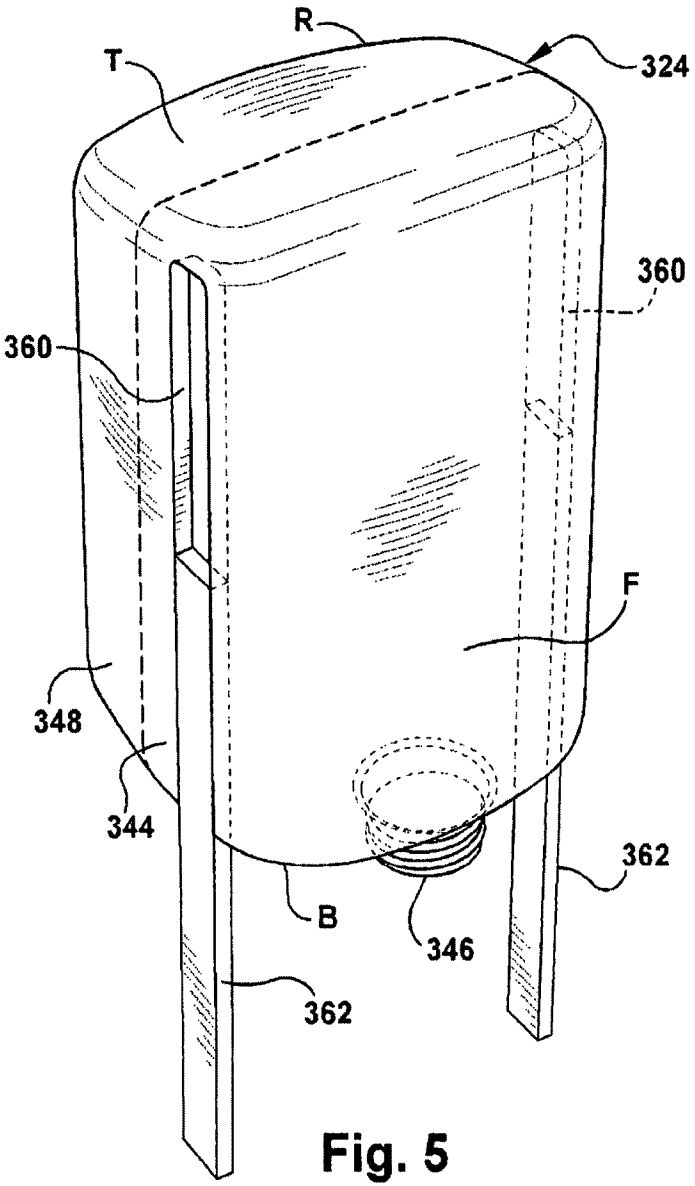
FIG. 5 is a perspective view of a container according to another embodiment, with parts partially installed.

Another exemplary embodiment of a container 324 that is suitable for use in the dispenser 20 is illustrated in FIG. 5. The container 324 defines a variable volume vessel and is constructed to decrease in volume as the material is dispensed and in response to a biasing force applied by the dispenser 20. The container 324 includes a first section 344. An outlet 346 is in fluid communication with the first section 344 for material within the container 324 to exit the container. The container 324 is preferably made of a material that is transparent. The first section 344 is formed with a pair of grooves 360 extending in a direction along the length of the container. Stiffening inserts 362 are received within the grooves 360 in order to prevent deformation or collapse of the first section 344 of the container 324 in a direction along its length.

The container 324 also includes a second section 348 in fluid communication with the first section 344. The second section 348 of the container 324 is constructed to be deformable or collapsible so that the volume of the second section decreases as material is dispensed from the container. The second section 348 of the container 324 is deformable and collapses upon the application of biasing force from the dispenser 20. For example, the second section 348 of the container 324 collapses in a direction substantially orthogonal to the extent of the inserts 362 in the first section 344. The inserts 362 are preferably made from a material that is relatively more rigid than the material from which the rest of the container 324 is made. Thus, the container 324 collapses from the rear R of the container in a direction towards the front F rather than in a direction from top T to bottom B.

The collapsing action of the second section 348 of the container 324 enables the movement of the material into the first section 344 of the container. Thus, when viewed through the viewport 42 of the dispenser 20, the container 324 appears to be full of material for a longer duration as material is dispensed. While the container 324 is illustrated as having two inserts 362, any suitable number of inserts 362 may be employed.

Figure 6:
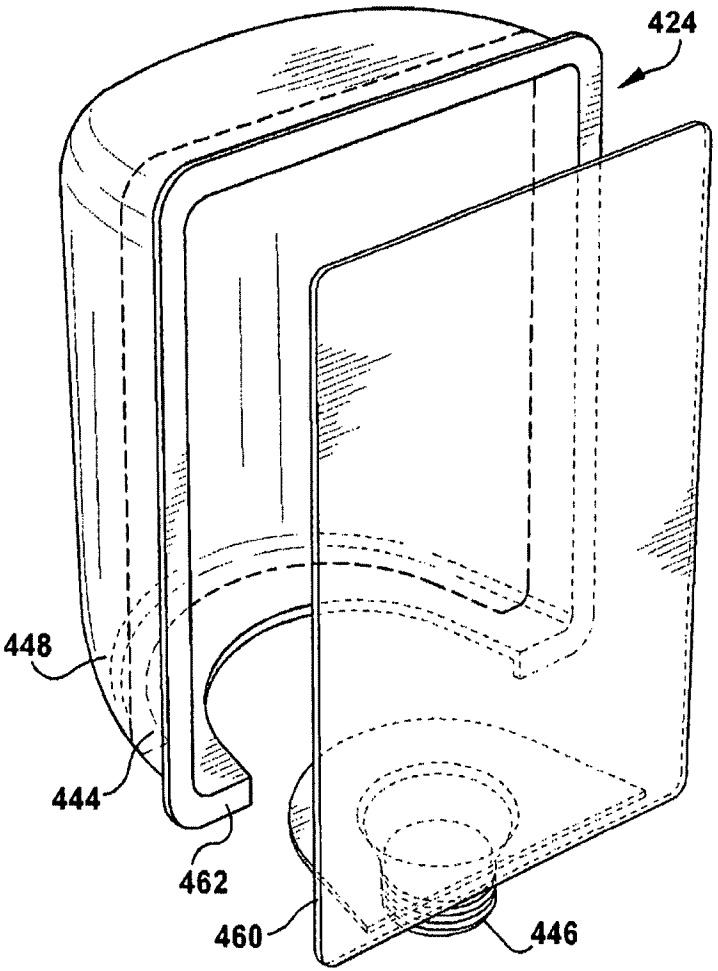
FIG. 6 is an exploded perspective view of a container according to another embodiment.

Another exemplary embodiment of a container 424 that is suitable for use in the dispenser 20 is illustrated in FIG. 6. The container 424 defines a variable volume vessel and is constructed to decrease in volume as the material is dispensed and in response to the application of the biasing force from the dispenser 20. The container 424 includes a first section 444 that is relatively rigid and resists deformation. The container 424 has an outlet 446 that is in fluid communication with the first section and through which the material can flow from the container 424. The first section 444 includes a face panel 460. The face panel 460 is made from a material that is relatively more rigid than the material from which a second section 448 of the container 424 is made. The face panel 460 is preferably made from a material that is transparent.

The second section 448 of the container 424 is in fluid communication with the first section 444. The second section 448 of the container 424 is constructed to be deformable or collapsible so that the volume of the second section decreases as material is dispensed from the container. The second section 448 of the container 424 is preferably constructed from a material that is relatively less rigid than face plate 460 of the first section 444. The face plate 460 is fixed to a flange 462 of the container 424 in any suitable manner such as by an adhesive or ultrasonic welding.

The collapsing action of the second section 448 of the container 424 causes the movement of the material into the first section 444 of the container. Thus, when viewed through the viewport 42 of the dispenser 20, the container 424 appears to be full of material for a longer duration as material is dispensed.

Figure 7:
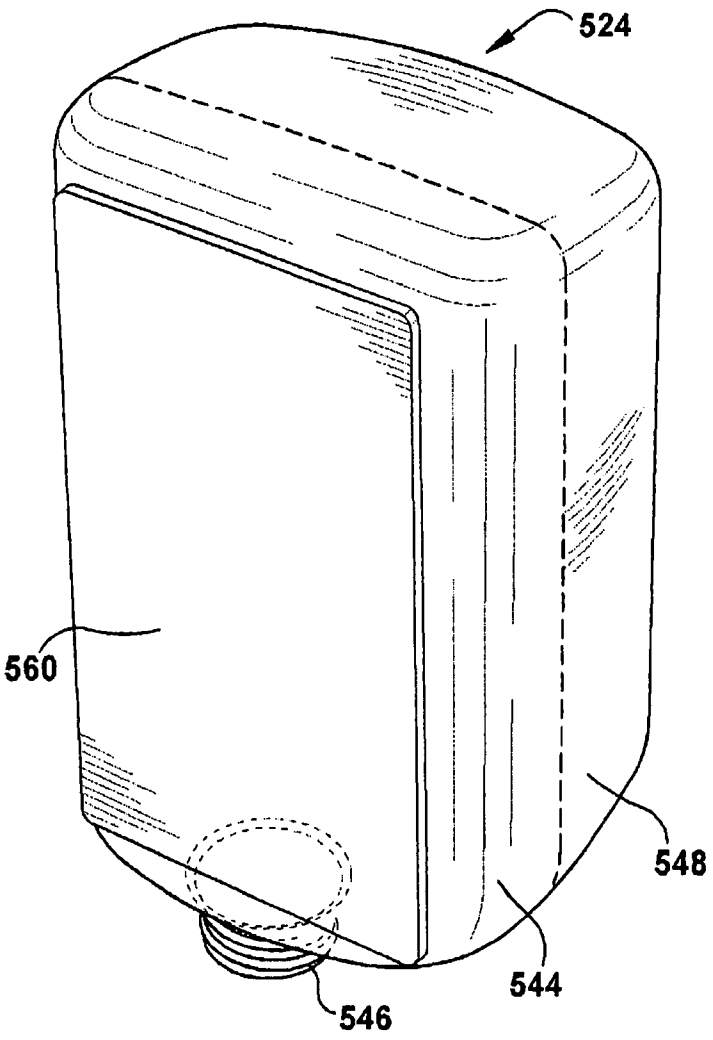
FIG. 7 is a perspective view of a container according to another embodiment having external reinforcing structure.

Another exemplary embodiment of a container 524 that is suitable for use in the dispenser 20 is illustrated in FIG. 7. The container 524 defines a variable volume vessel and is constructed to decrease in volume as the material is dispensed and in response to the application of force from the dispenser 20. The container 524 includes a first section 544 that is relatively rigid and resists deformation. The container 524 has an outlet 546 that is in fluid communication with the first section and through which the material can be dispensed from the container 524.

The first section 544 also includes external reinforcement structure 560. The external reinforcement structure 560 is made from a material that is relatively more rigid than the material from which one or more other portions of the container 524 are made. The external reinforcement structure 560 and the remainder of the container 524 are preferably made from a material that is transparent. The external reinforcement structure 560 is attached to the first section 544 of the container 524 in a suitable manner such as by adhesive bonding or ultrasonic welding.

The container 524 also includes a second section 548 in fluid communication with the first section 544. The second section 548 of the container 524 is constructed to be deformable or collapsible so that the volume of the second section decreases as material is dispensed from the container.

The collapsing action of the second section 548 of the container 524 causes the movement of the material into the first section 544 of the container. Thus, when viewed through the viewport 42 of the dispenser 20, the container 524 appears to be full of material for a longer duration as material is dispensed.

Figure 8:
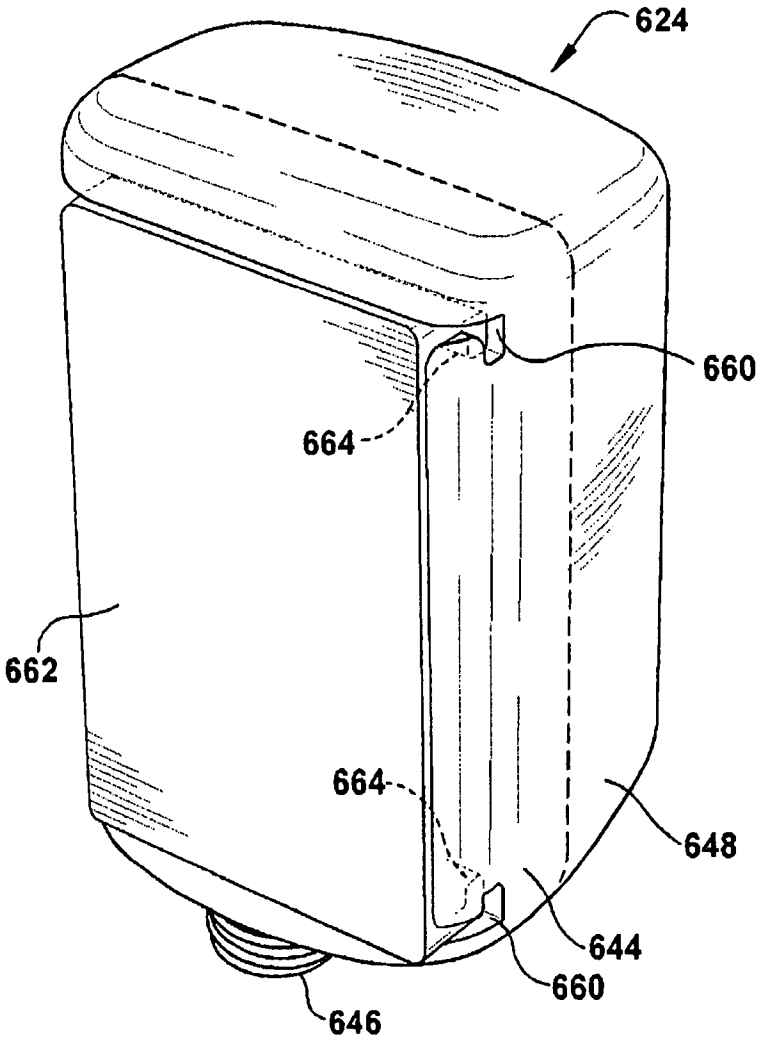
FIG. 8 is a perspective view of a container according to another embodiment having external reinforcing structure.

Another exemplary embodiment of a container 624 that is suitable for use in the dispenser 20 is illustrated in FIG. 8. The container 624 defines a variable volume vessel and is constructed to decrease in volume as the material is dispensed and in response to the application of the biasing force from the dispenser 20. The container 624 includes a first section 644 that is relatively rigid and resists deformation. The container 624 has an outlet 646 that is in fluid communication with the first section and through which the material can be dispensed from the container 624.

The first section 644 includes a pair of locking grooves 660 extending transversely along the front of the container 624. Each of the locking grooves 660 has a substantially L-shape when taken in cross-section. The first section 644 also includes external reinforcing structure 662. The external reinforcing structure 662 is made from a material that is relatively more rigid than the material from which one or more other portions of the container 624 are made. The external reinforcing structure 662 and remainder of the container 624 are preferably transparent. The external reinforcing structure 662 includes a pair of L-shaped extensions 664. The external reinforcing structure 662 is attached to the first section 644 of the container 624 by sliding the external reinforcing structure along front of the container 624 so that the L-shaped extensions 664 enter into respective grooves 660. The addition of the external reinforcing structure 662 to the front of the container 624 stiffens the first section 644 to resist deformation.

The container 624 also includes a second section 648 in fluid communication with the first section 644. The second section 648 of the container 624 is constructed to be deformable or collapsible so that the volume of the second section decreases as material is dispensed from the container.

The collapsing action of the second section 648 of the container 624 causes the movement of the material into the first section 644 of the container. Thus, when viewed through the viewport 42 of the dispenser 20 the container 624 appears to be full of material for a longer duration as material is dispensed.

Figure 9:
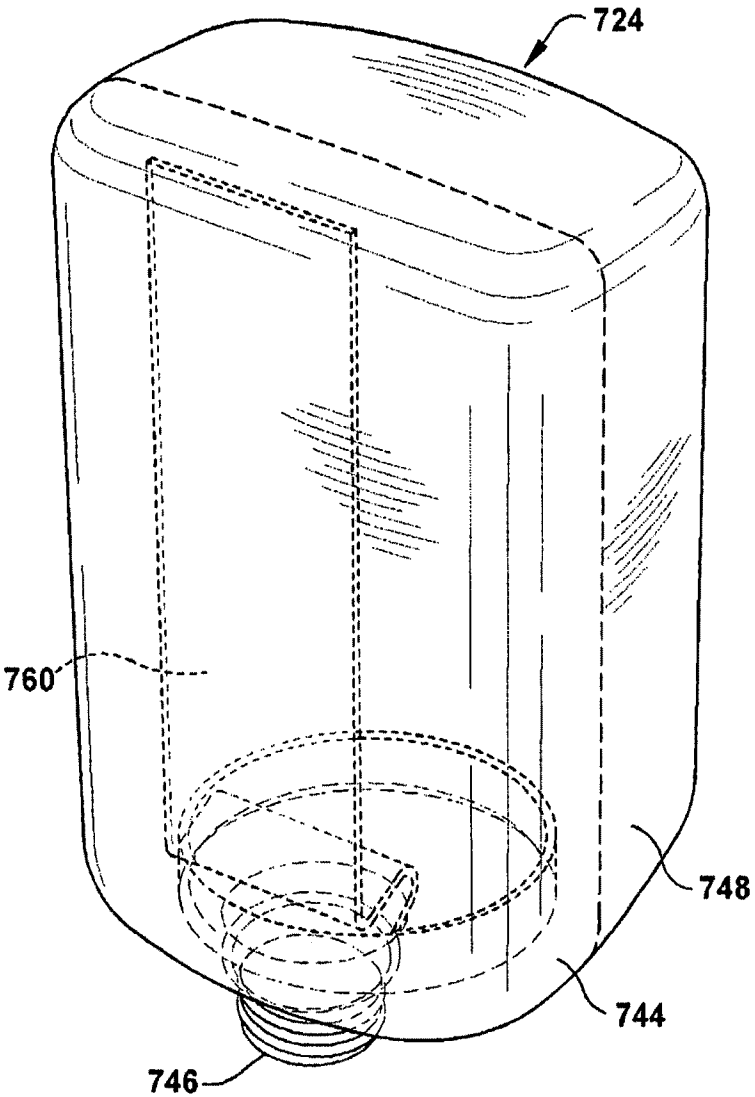
FIG. 9 is a perspective view of a container according to another embodiment with internal reinforcing structure.

Another exemplary embodiment of a container 724 that is suitable for use in the dispenser 20 is illustrated in FIG. 9. The container 724 defines a variable volume vessel and is constructed to decrease in volume as the material is dispensed and in response to the application of the biasing force. The container 724 includes a first section 744 that is relatively rigid and resists deformation. The first section 744 includes internal reinforcement structure. The container 724 has an outlet 746 that is in fluid communication with the first section and through which the material can be dispensed from the container 724. The container 724 is preferably made from a material that is relatively transparent so that the level of material within the container may be viewed.

The first section 744 includes an internal reinforcing panel 760 extending along the front of the container 724. The internal reinforcing panel 760 is substantially flat and rectangular in shape. While a rectangular shape is illustrated, it will be apparent that any shape and/or size of internal reinforcing panel 760 may be employed. The internal reinforcing panel 760 is made from a material that is relatively more rigid than the material from which one or more other portions of the container 724 are made. The container 724 may be molded around the internal reinforcing panel 760. Alternatively, the internal reinforcing panel 760 may be installed into the container 724 through the outlet 746.

The container 724 also includes a second section 748 in fluid communication with the first section 744. The second section 748 of the container 724 is constructed to be deformable or collapsible so that the volume of the second section decreases as material is dispensed from the container.

The collapsing action of the second section 748 of the container 724 causes the movement of the material into the first section 744 of the container. Thus, when viewed through the viewport the container 724 appears to be full of material for a longer duration as material is dispensed.

Figure 10:
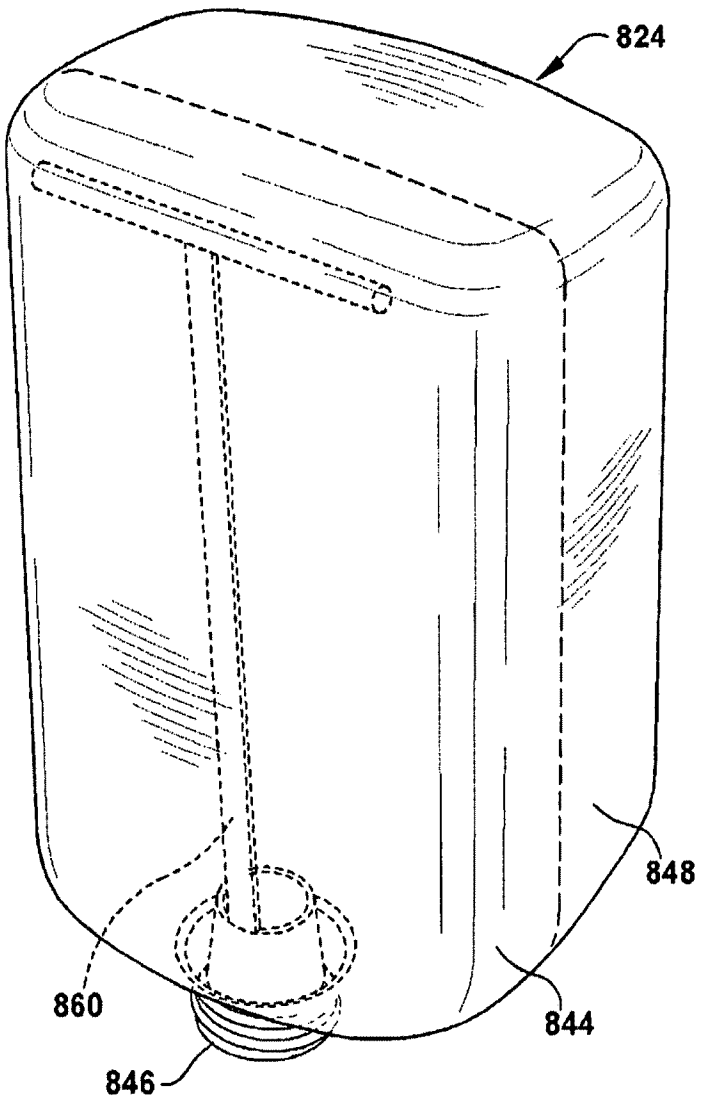
FIG. 10 is a perspective view of a container according to another embodiment with internal reinforcing structure.

Another exemplary embodiment of a container 824 that is suitable for use in the dispenser 20 is illustrated in FIG. 10. The container 824 defines a variable volume vessel and is constructed to decrease in volume as the material is dispensed and in response to the application of the biasing force. The container 824 includes a first section 844 that is relatively rigid and resists deformation. The first section 844 includes internal reinforcement structure. The container 824 has an outlet 846 that is in fluid communication with the first section and through which the material can be dispensed from the container 824. The container 824 is preferably made from a material that is relatively transparent so that the level of material within the container may be viewed.

The first section 844 includes an internal reinforcing bar 860 extending along the front of the container 824. The internal reinforcing bar 860 is substantially T-shaped. While a T-shape is illustrated, it will be apparent that any shape and/or size of internal reinforcing bar 860 may be employed. The internal reinforcing bar 860 is made from a material that is relatively more rigid than the material from which one or more other portions of the container 824 are made. The container 824 may be molded around the internal reinforcing bar 860 or at least a portion of the internal reinforcing bar may be inserted through the outlet 846.

The container 824 also includes a second section 848 in fluid communication with the first section 844. The second section 848 of the container 824 is constructed to be deformable or collapsible so that the volume of the second section decreases as material is dispensed from the container.

The collapsing action of the second section 848 of the container 824 causes the movement of the material into the first section 844 of the container. Thus, when viewed through the viewport the container 824 appears to be full of material for a longer duration as material is dispensed.

Figure 11:
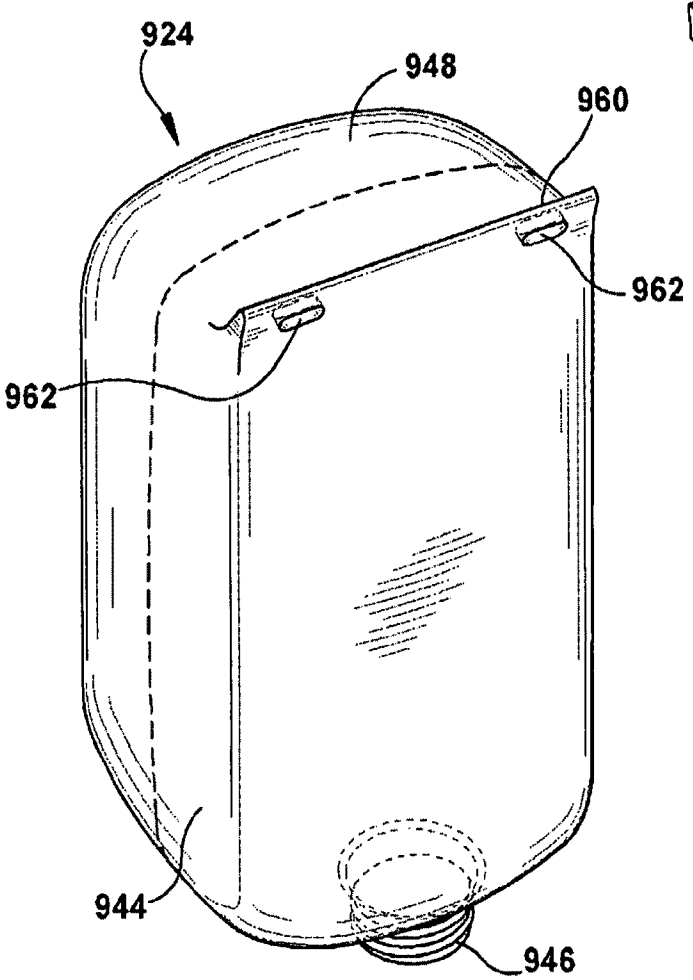
FIG. 11 is a perspective view of a container according to another embodiment having hanging structure.

Another exemplary embodiment of a container 924 that is suitable for use in the dispenser 20 is illustrated in FIG. 11. The container 924 defines a variable volume vessel and is constructed to decrease in volume as the material is dispensed and in response to the application of the biasing force. The container 924 includes a first section 944 that resists deformation by being suspended from mounting structure in the dispenser 20. The container 924 has an outlet 946 that is in fluid communication with the first section and through which the material can be dispensed from the container 924. The container 924 is preferably made from a material that is that is relatively transparent so that the level of material within the container may be viewed. The container 924 may also be made from a relatively flexible material.

The container 924 also includes a second section 948 in fluid communication with the first section 944. The second section 948 of the container 924 is constructed and positioned to be deformable or collapsible so that the volume of the second section decreases as material is dispensed from the container.

The first section 944 includes an external mounting portion 960 extending along the upper front of the container 924. It will be apparent that the mounting portion 960 may be fixed to the container 924 at any suitable location in an uppermost portion of the container. The mounting portion 960 can be gathered material or a crease made from the material of the container 924. While a single mounting portion extending along the entire width of the container 924 is illustrated, it will be apparent that any number of tabs or mounting portions may be employed. The mounting portion 960 includes a pair of (e.g., elongated) openings 962 from which the mounting portion and, thus, the container 924 may be suspended by suitable structure of the dispenser 20. While a pair of openings 962 is illustrated, it will be apparent that any number and/or suitable shape of openings may be employed. The mounting portion 960 essentially provides the structure for the first section 944 to resist deformation by continuously pulling tight the front of the first section 944.

When the container 924 is suspended in a dispenser 20, the biasing force may be applied from the rearward portion of the container and from the top. For example, the biasing structure may be constructed and mounted so that (e.g., only) the upper portion of the second section 948 of the container 924 is engaged to force deformation locally adjacent the contact.

The collapsing action of the second section 948 of the container 924 causes the movement of the material into the first section 944 of the container. Thus, when viewed through the viewport the container 924 appears to be full of material for a longer duration as material is dispensed.

Figure 12:
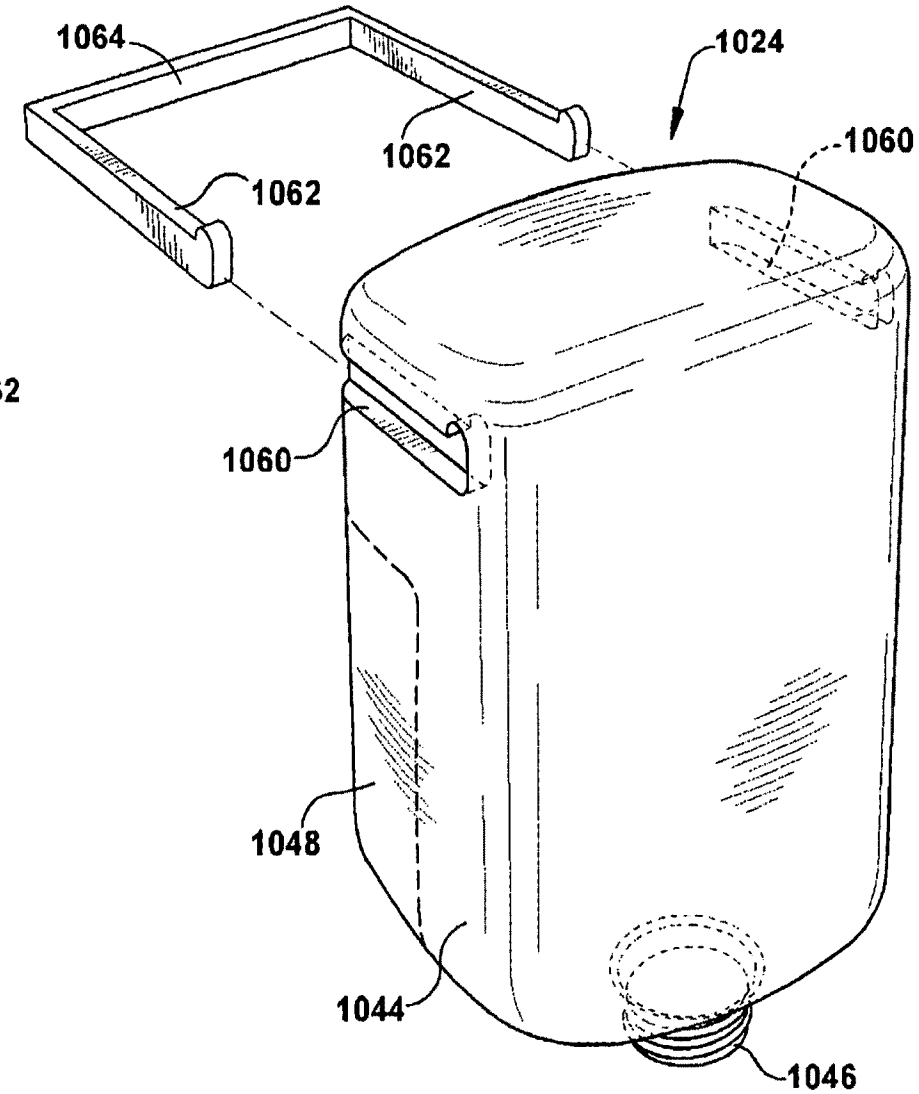
FIG. 12 is a perspective view of a container according to another embodiment having external reinforcing structure.

Another exemplary embodiment of a container 1024 that is suitable for use in the dispenser 20 is illustrated in FIG. 12. The container 1024 defines a variable volume vessel and is constructed to decrease in volume as the material is dispensed and in response to the application of the biasing force. The container 1024 includes a first section 1044 located at the front and upper region of the container, as viewed in FIG. 12. The container 1024 has an outlet 1046 that is in fluid communication with the first section and through which the material can be dispensed from the container 1024. The container 1024 is preferably made from a material that is that is relatively transparent so that the level of material within the container may be viewed.

The container 1024 also includes a second section 1048 in fluid communication with the first section 1044. The second section 1048 is located at the rear and lower region of the container. The second section 1048 of the container 1024 is constructed to be deformable or collapsible so that the volume of the second section decreases as material is dispensed from the container.

The first section 1044 is formed with a pair of grooves 1060 extending in a direction along the depth of the container 1024. A pair of stiffening inserts 1062 is connected together by a connecting portion 1064. The stiffening inserts 1062 are inserted into the grooves 1060 in the container 1024. The stiffening inserts 1062 provide structure to resist deformation or collapse of the first section 1044 of the container 1024 in a direction along its depth. The stiffening inserts 1062 may be stand-alone structure or may be attached or mounted to the dispenser 20.

When the container 1024 is suspended in the dispenser 20, the biasing force may be applied from the lower rearward portion of the container. For example, the biasing structure may be constructed and mounted so that the biasing structure engages (e.g., only) the second section 1048 of the container.

The collapsing action of the second section 1048 of the container 1024 causes the movement of the material into the first section 1044 of the container. Thus, when viewed through the viewport the container 1024 appears to be full of material for a longer duration as material is dispensed.

Figure 14:
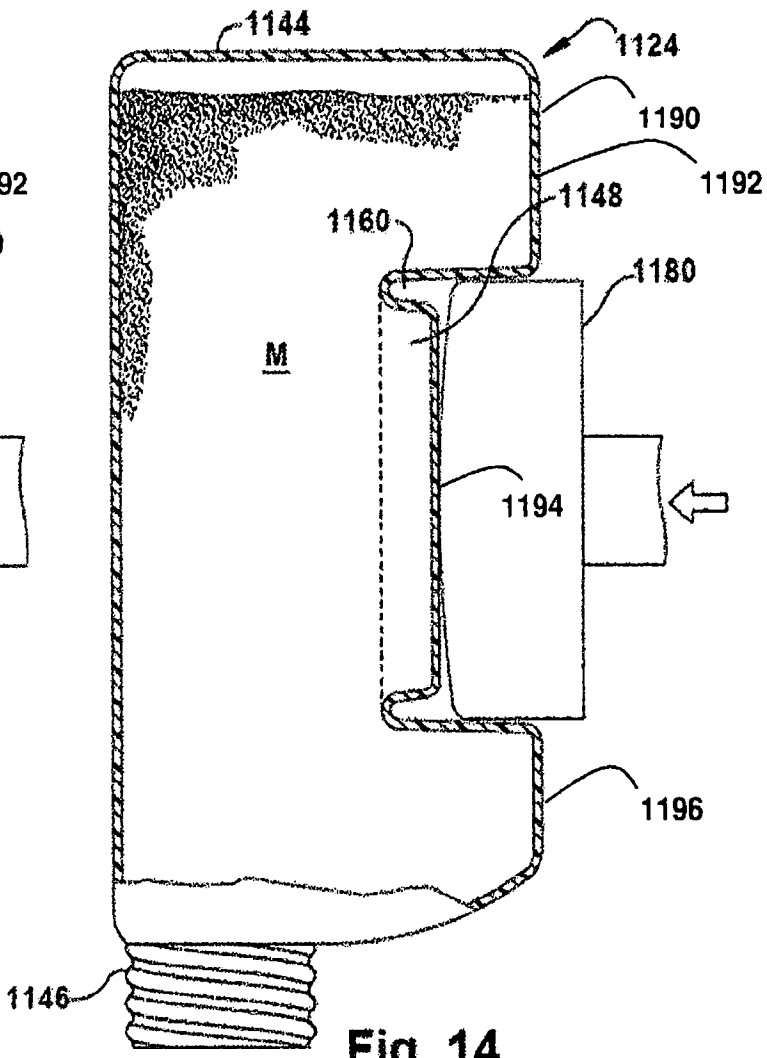
FIG. 14 is a cross-sectional view of a container and portion of a biasing structure illustrated in a second position.
Figure 13:
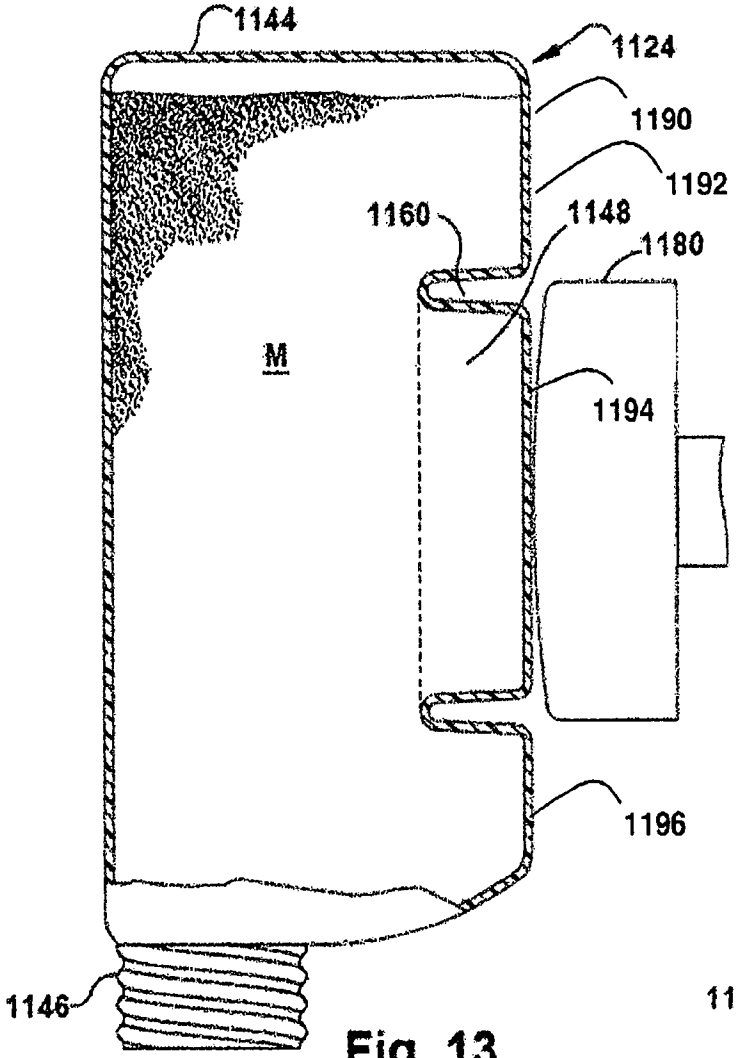
FIG. 13 is a cross-sectional view of a container and portion of a biasing structure illustrated in a first position.

Another exemplary embodiment of a container 1124 that is suitable for use in the dispenser 20 is illustrated in FIGS. 13 and 14. The container 1124 defines a variable volume vessel and is constructed to decrease in volume as the material is dispensed and in response to the application of the biasing force. The container 1124 includes a first section 1144 that is relatively rigid and resists deformation. The container 1124 has an outlet 1146 that is in fluid communication with the first section and through which the material can be dispensed from the container 1124. The container 1124 is preferably made from a material that is relatively transparent so that the level of material within the container may be viewed. The container 1124 also includes a rear wall 1190 opposite the viewport. The rear wall can include several portions such as a first portion 1192, a second portion 1194, and a third portion 1196.

The container 1124 also includes a second section 1148 in fluid communication with the first section 1144. The second section 1148 is located in the central rear region of the container 1124 by forming a groove 1160 into the container. The second section 1148 of the container 1124 is constructed to be deformable or collapsible so that the volume of the second section decreases as material is dispensed from the container.

The dispenser 20 also includes a movable biasing force applicator 1180. The biasing force applicator 1180 is supported by the dispenser 20 and may form part of the dispenser structure. The biasing force applicator 1180 is shaped complementary to the shape of the second section 1148 of the container 1124. The biasing force applicator 1180 is shown in an initial position in FIG. 13. The biasing force applicator 1180 is movable in a direction towards the front of the container 1124. The biasing force applicator 1180 is illustrated in FIG. 14 as engaging and thereby collapsing the second section 1148 to decrease the volume of the second section.

The collapsing action of the second section 1148 of the container 1124 causes the movement of the material into the first section 1144 of the container. Thus, when viewed through the viewport the container 1124 appears to be full of material for a longer duration as material is dispensed.

Figure 16:
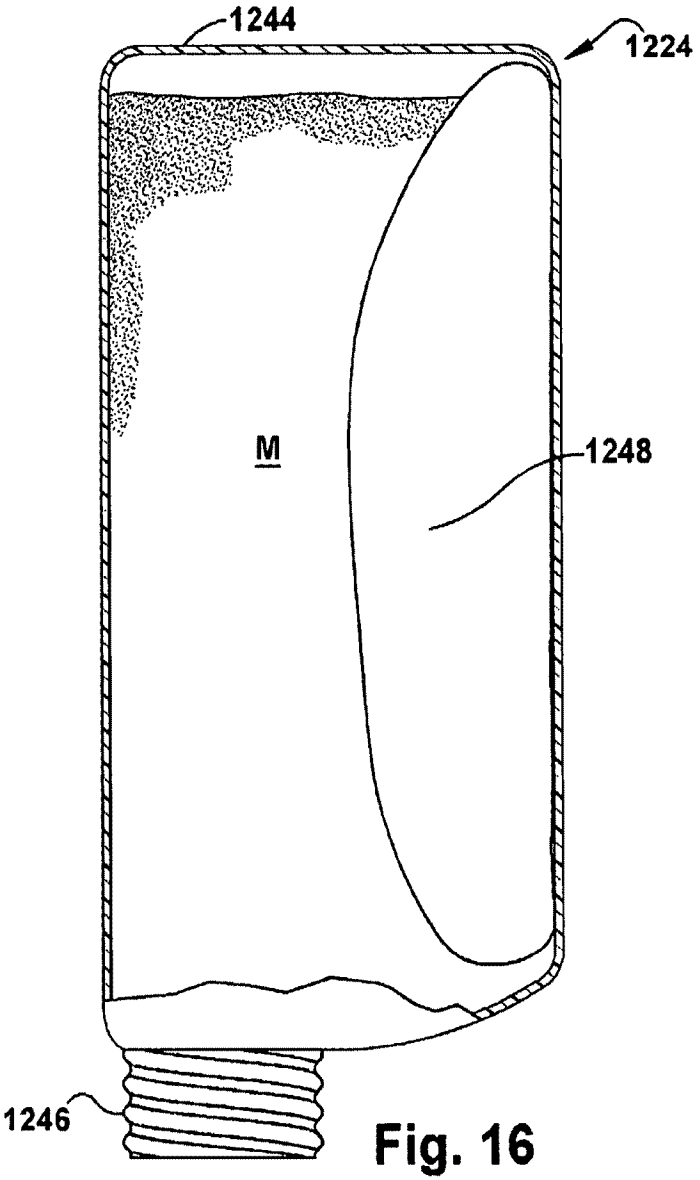
FIG. 16 is a cross-sectional view of a container according to another embodiment having internal biasing structure in a second position.
Figure 15:
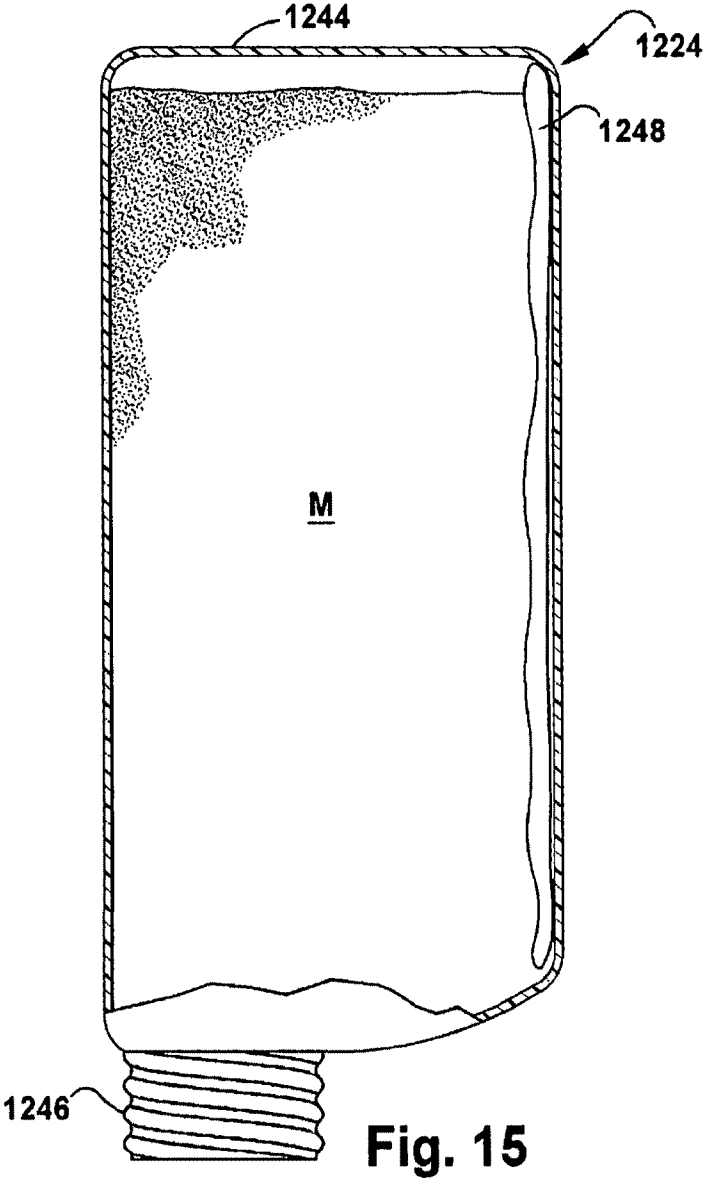
FIG. 15 is a cross-sectional view of a container according to another embodiment having internal biasing structure in a first position.

Another exemplary embodiment of a container 1224 that is suitable for use in the dispenser 20 is illustrated in FIGS. 15 and 16. The container 1224 defines a vessel that has a portion that varies in volume to displace empty space within the container as the material is dispensed (e.g., in the absence of the biasing force). The container 1224 includes self-contained biasing structure. The container 1224 includes a first section 1244 that is relatively rigid and resists deformation. The container 1224 has an outlet 1246 that is in fluid communication with the first section and through which the material can be dispensed from the container 1224. The container 1224 is preferably made from a material that is relatively transparent so that the level of material within the container may be viewed.

The container 1224 also includes a second section 1248 which serves as biasing structure. The second section 1248 of the container 1224 is constructed to be deformable or expansible so that the volume of the second section increases as material is dispensed from the container. The second section 1248 is preferably a pressurized bladder. In its initial condition it appears as occupying a relatively small volume within the container 1224, as illustrated in FIG. 15. This is due to the pressure of the material M in the container 1224 overcoming the pressure within the bladder of the second section 1248. As material is dispensed from the container 1224, the pressure of the material in the first section decreases and the bladder of the second section 1248 expands, as illustrated in FIG. 16.

The second section 1248 engages an inner wall of the container 1224. The expanding action of the second section 1248 of the container 1224 causes the movement of the material in the first section 1244 of the container. The expanding second section 1248 of the container 1224 displaces void volume within the container and thereby causes the level of the material M to appear relatively constant and full as the material is dispensed from the container 1224. Thus, when viewed through the viewport the container 1224 appears to be full of material for a longer duration as material is dispensed.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing the claims.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, aspect, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A dispenser for dispensing material, the dispenser comprising:

a cover supporting the dispenser for use;

a biasing force applicator within an interior defined by the cover;

a viewport in the cover; and a container within the interior for storing the material, the container comprising:

a rear wall opposite the viewport;

a first section adjacent a first portion of the rear wall, the first section constructed to resist deformation and having an outlet aligned with an aperture in the cover for dispensing the material;

a transparent structure in the first section of the container aligned with the viewport in the cover so the material in the container is visible through the viewport and the transparent structure; and a second section adjacent a second portion of the rear wall, the second section constructed to be deformable from an undeformed state to a deformed state, and the second section is in fluid communication with the first section, wherein:

the biasing force applicator is associated with the second section of the container and adapted to apply a force to the second section to deform the second section from the undeformed state to the deformed state and move the material in the container in a direction towards the viewport, and when the second section is in the deformed state, the first portion of the rear wall is located a first distance from the viewport and the second portion of the rear wall is located a second distance from the viewport, the second distance less than the first distance.

2. The dispenser of claim 1, comprising a biasing structure in the cover adapted to urge the biasing force applicator toward the second section.

3. The dispenser of claim 1, wherein the first portion of the rear wall is coplanar with the second portion of the rear wall when the second section is in the undeformed state.

4. The dispenser of claim 1, wherein the second portion of the rear wall is not coplanar with the first portion of the rear wall when the second section is in the deformed state.

5. The dispenser of claim 1, wherein when the second section is in the deformed state, a third portion of the rear wall is located at the first distance from the viewport and the second portion of the rear wall is located at the second distance from the viewport.

6. The dispenser of claim 1, wherein at least one of the container or the cover is coupled to a handle that, upon actuation, effects the dispensing of the material.

7. The dispenser of claim 1, wherein the container is made from plastic.

8. The dispenser of claim 1, wherein the material is fluent material.

9. The dispenser of claim 1, comprising a biasing structure disposed between the biasing force applicator and the cover, the biasing structure providing a biasing force to the biasing force applicator to deform the second section.

10. A container for material used with a dispenser for dispensing the material, the dispenser having a cover to mount the dispenser for use and a viewport in the cover, the dispenser also having a biasing structure effective to provide a biasing force to the container, the container comprising:

a first section with an outlet for material to exit the container, the first section constructed to resist deformation;

a second section in fluid communication with the first section, the second section constructed to be deformable in response to the biasing force applied by the biasing structure; and a transparent structure in the first section of the container adapted to be aligned with the viewport so the material in the container can be viewed, wherein:

the material in the container is urged in a direction towards the first section of the container and the transparent structure upon the biasing structure applying the biasing force to the second section, and the second section is between a first portion of the first section and a second portion of the first section.

11. The container of claim 10, wherein the container is made from plastic.

12. The container of claim 10, wherein the second section is urged from an undeformed state to a deformed state as the biasing force is applied to the second section by the biasing structure through a biasing force applicator.

13. The container of claim 12, wherein the biasing force applicator has a shape complementary to a shape of the second section.

14. The container of claim 12, wherein an angle between a wall of the second section contacted by the biasing force applicator and a wall of the first section remains constant when the second section is urged from the undeformed state to the deformed state.

15. A dispenser for dispensing material, the dispenser comprising:

a cover supporting the dispenser for use, the cover comprising a biasing force applicator within an interior defined by the cover;

viewport in the cover; and a container within the interior for storing the material, the container comprising:

a rear wall opposite the viewport;

a first section adjacent a first portion of the rear wall, the first section constructed to resist deformation and having an outlet aligned with an aperture in the cover for dispensing the material;

a transparent structure in the first section of the container aligned with the viewport in the cover so the material in the container is visible through the viewport and the transparent structure; and a second section adjacent a second portion of the rear wall, the second section constructed to be deformable from an undeformed state to a deformed state, and the second section is in fluid communication with the first section, wherein:

the second section is separated from the first section by a groove located in the rear wall.

16. The dispenser of claim 15, wherein the container is made from plastic.

17. The dispenser of claim 15, wherein the first section and the second section form a unitary container, and the first section and the second section are molded as a monolithic piece.

18. The dispenser of claim 15, wherein the first section of the container has a first wall thickness and the second section of the container has a second wall thickness different than the first wall thickness.

19. The dispenser of claim 15, wherein the second portion of the rear wall lies between the first portion of the rear wall and a third portion of the rear wall adjacent the first section.

20. A dispenser, for dispensing material, the dispenser comprising:

a cover supporting the dispenser for use;

a biasing force applicator within an interior defined by the cover;

a viewport in the cover; and a container within the interior for storing the material, the container comprising:

a rear wall opposite the viewport;

a first section adjacent a first portion of the rear wall, the first section constructed to resist deformation and having an outlet aligned with an aperture in the cover for dispensing the material;

a transparent structure in the first section of the container aligned with the viewport in the cover so the material in the container is visible through the viewport and the transparent structure; and a second section adjacent a second portion of the rear wall, the second section constructed to be deformable from an undeformed state to a deformed state, and the second section is in fluid communication with the first section, wherein;

the biasing force applicator is associated with the second section of the container and adapted to apply a force to the second section to deform the second section from the undeformed state to the deformed state and move the material in the container in a direction towards the viewport, and the second portion of the rear wall lies between the first portion of the rear wall and a third portion of the rear wall adjacent the first section.

* * * * *